United States Patent [19]

D'Epenoux

[11] Patent Number: 4,811,537

[45] Date of Patent: Mar. 14, 1989

[54] COMPOSITE WALL FACING CONSTRUCTION WITH APPARENT STONES

[75] Inventor: Francois D'Epenoux, Paris, France

[73] Assignee: Rocamat, Puteaux, France

[21] Appl. No.: 877,528

[22] Filed: Jun. 23, 1986

[30] Foreign Application Priority Data

Jun. 24, 1985 [FR] France ..... 85 09573
Jul. 15, 1985 [FR] France ..... 85 10820

[51] Int. Cl.[4] ..... E04F 13/08

[52] U.S. Cl. ..... 52/385; 52/235; 52/404; 52/508; 52/511

[58] Field of Search ..... 52/315, 309.8, 235, 52/509, 508, 593, 404, 713, 391, 404, 713, 391, 379, 378, 385, 405, 309.12, 387, 388, 384, 389

[56] References Cited

U.S. PATENT DOCUMENTS

| | | | |
|---|---|---|---|
| 1,861,359 | 5/1932 | Pyron | 52/387 |
| 2,054,573 | 9/1936 | Mendenhall | 52/385 |
| 2,853,870 | 9/1958 | Sinner | 52/509 |
| 2,938,376 | 5/1960 | Workman | 52/391 |
| 3,434,257 | 3/1969 | Sakuma | 52/387 |
| 3,559,358 | 2/1971 | Lohse | 52/513 |
| 3,740,909 | 6/1973 | Stinnes | 52/315 |
| 3,786,605 | 1/1974 | Winfrey | 52/235 |

FOREIGN PATENT DOCUMENTS

| | | | |
|---|---|---|---|
| 2914073 | 10/1980 | Fed. Rep. of Germany | 52/508 |
| 1143592 | 10/1957 | France | 52/513 |

*Primary Examiner*—John E. Murtagh
*Attorney, Agent, or Firm*—Browdy & Neimark

[57] ABSTRACT

The composite wall facing construction with apparent stones is made of facing plates each comprising a stone slab fixed to a core made of an insulating material. The stone slabs are formed with at least two holes in its side edges for receiving retention studs connected to a wall. The facing plates are stacked onto each other at least first supported by the core, and a mortar joint is packed between the stone slabs for permanent support.

22 Claims, 4 Drawing Sheets

25
31
30
30a
32
32

29
14a
25
30

26
28
27
29
33
1
14a
13a
25
4
30
32

VII
27
14a
V
V
26
28
29
VII 27
28
1
33
14a

COMPOSITE WALL FACING CONSTRUCTION WITH APPARENT STONES

FIELD OF THE INVENTION

The present invention relates to a new composite wall facing construction with apparent stones, which is made by stacking onto each other self-supporting facing plates providing a thermal insulation function to a facade.

In a preferred embodiment, the facing plates fit into each other horizontally and vertically and have an appearance of a massive stone masonry.

A three dimensional adjustable fixation device provides a desired stability against falling forward away from the wall and a strength to impact.

The fixation device has no support function since the vertical load of the stones is directed through joints providing a connection, horizontally as well as vertically, of the plates together.

The invention provides also support brackets which take over the downward vertical charges and thereby limit the compression forces exerted on the stone slabs, which enables to form facing construction of a rather large height, for example about ten floors high, divided by so-called decompression horizontal joints, possibly every second floor.

SUMMARY OF THE INVENTION

According to the invention, the composite wall facing construction with apparent stones is made of facing plates each comprising a stone slab fixed to an insulating material core, the stone slab being formed with at least two holes in the side edges thereof for receiving retention studs connected to a wall, the facing plates being stacked onto each other in order to first be supported via the core, and a mortar joint being packed between the stone slabs so that compression forces due to weight of the stones are transmitted by the mortar joint.

As it appears from the foregoing disclosure, the insulating core fixed to the stone:

(1) provides a self-bearing capacity of the plates when being laid, (2) imparts to the stone facing, which is fixed to it over its whole surface, a much larger rigidity than that of fastened stone facade facing constructions presently existing, (3) protects the angles and edges of the stone slabs during transportation and handling, (4) provides the facing plate with thermal insulation characteristics, (5) and forms a barrier opposing penetration of humidity.

Each stone slab being perforated edgewise so as to house retention fasteners, this avoids buckling of the facing construction even when there is an accidental disconnection between a stone slab and the insulating core fixed thereto.

Various other features of the invention will become more apparent from the following detailed description.

BRIEF DESCRIPTION OF THE DRAWINGS

Embodiments of the invention are shown by way of non limiting examples in the accompanying drawings, wherein.

DETAILED DESCRIPTION OF THE INVENTION

Figure 1:
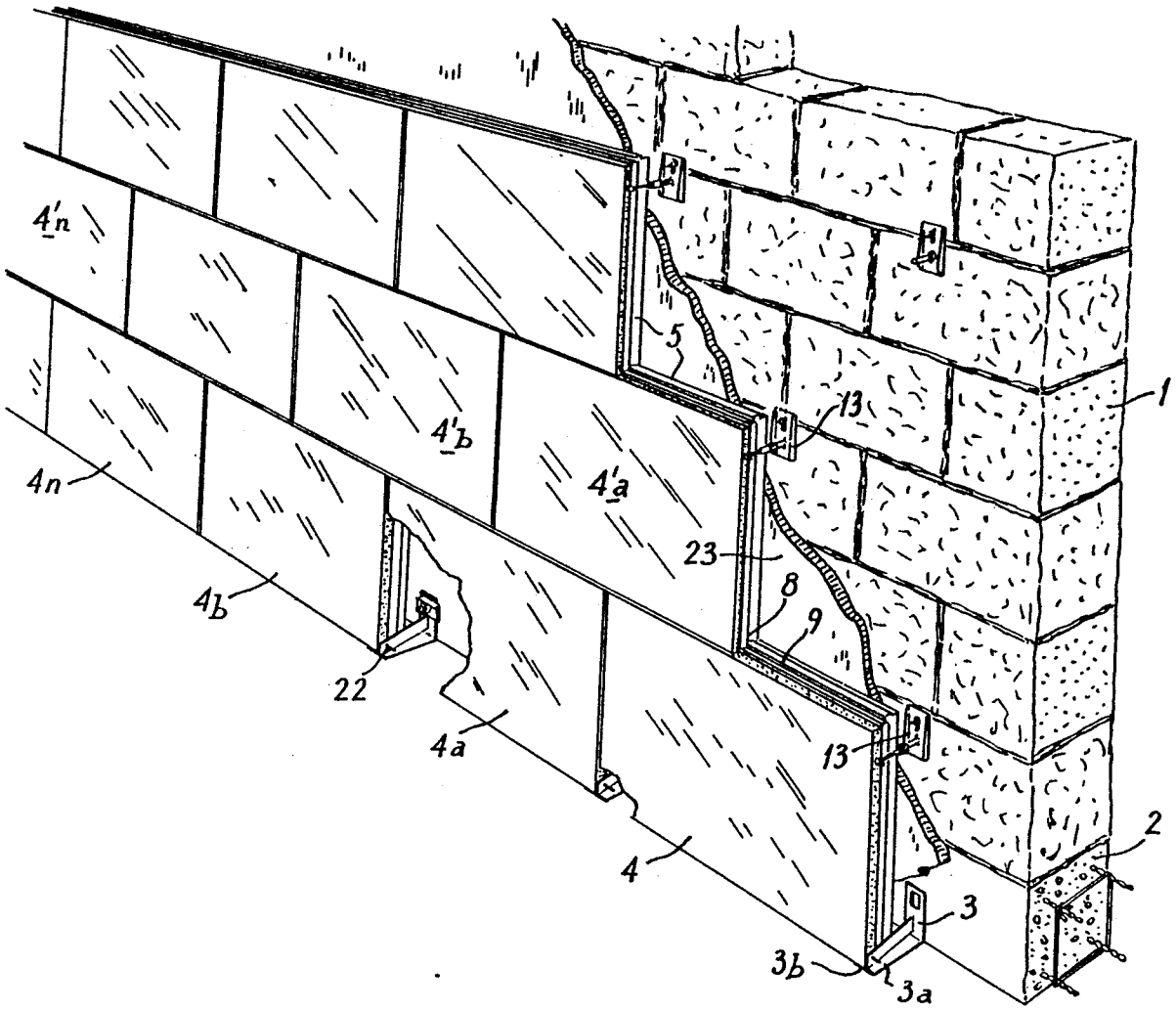
FIG. 1 is a partially broken away perspective view of a wall and of a facing construction made according to the invention.

FIG. 1 shows a wall 1, for example made of building blocks, mounted on an reinforced concrete support 2. The support 2 can be brace, a foundation or an anchorage element.

The support 2 is equipped with square-shaped brackets 3, each defining two bearing planes 3*a*, 3*b*.

In a manner known in the art, the brackets 3 can have an other shape than that shown and can be made adjustable in order to take in account dimension tolerances and deviations which can exist between the support 2 and the facing construction described in the following disclosure.

The facing construction as such is made of stone slabs 4 which are fixed, for example as by gluing, on a core 5 (FIGS. 2, 3) made of a water-tight insulating material such as a synthetic foamed resin the nature of which is preferably chosen so tht the cells of the foamed resin are closed. An expanded polystyrene of a flame-retardant quality is appropriate in this respect. The core 5 protrudes on two of the sides of the stone slabs 4 for defining shoulders 6, 7 having a width corresponding to that of the joint thickness which has to separate the stone slabs 4 when they are assembled.

The core 5 is conformed in such a manner as to include a female fitting formation 8 in its lower portion and a male fitting formation 9 in its top portion, as well as two complementary vertical rabbets 10, 11 on the left hand and right hand sides of the core 5, respectively. The respective shapes of the rabbets 10, 11 are advantageously the same as those of the hereabove female and male fitting formations 8, 9.

Conformations of the male and female fitting formations 8, 9 and of the rabbets 10, 11 are such as to define, with ribbon forming portions 6, 7, a uniform joint between the stone slabs 4 during assembly.

Figure 3:
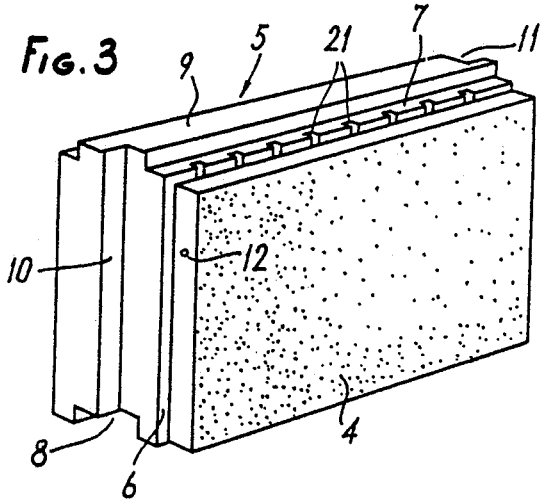

Slots 21 can be provided in the core 5, as shown in FIG. 3, for draining water which can have possibly seeped through the slabs or the joints described in the following disclosure.

The stone slabs 4 are formed with holes 12, as for example in the vertical side edges adjacent their upper side. The thickness of the stone slab 4 is normally between 10 and 20 mm, and the diameter of the holes 12 can be within the range of 3 to 5 mm, for example.

Figure 4:
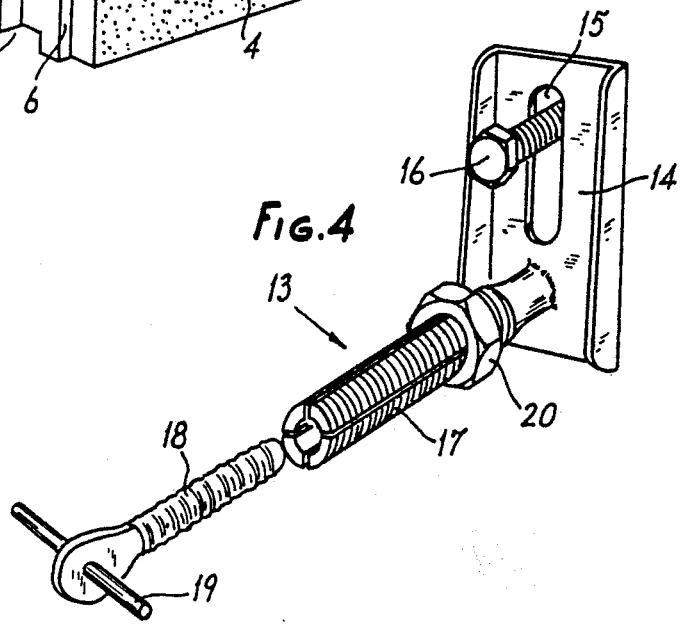
FIG. 4 is a perspective view of a retention stud device used in the facing construction of FIG. 1.

In order to support the facing construction while being assembled, there is provided retention stud devices 13 which can be devices available in the trade, or made as shown in FIG. 4.

According to FIG. 4, the retention stud device 13 comprises a sole 14 formed with an oblong hole 15 for passage of a fixation pin 16. Owing to shape of the oblong hole 15, a side and vertical adjustment of the retention stud device 13 is made very easy. The sole 14 supports a slit bolt 17 which is innerly bored in order to enable introduction of a stem 18, with a rough surface, the head of which being provided with a double stud 19. A nut 20 screwed into the slit bolt 17 enables to secure against motion the stem 18 in any position.

In order to position the wall facing construction, one can proceed as follows:

First of all, a first bracket 3 is fixed; a first composite facing element having holes 12 in the stone slabs 4, for corresponding to studs 22 provided on each bracket 3, is set in position; a second bracket 3 is set in position; and then two retention stud devices 13, the retention studs 19 of which are engaged into the holes 12 of the stone slab 4, are disposed on either side of the facing element supported by the two brackets 3.

The first facing plate is thus maintained at four points while bearing on two brackets 3. It can be advantageous to introduce a resin or any other bonding material into the holes 12 in which are engaged the studs 19 and 22.

Then, other plates 4*a*, 4*b* . . . 4*n* are set in position in the very same manner until a first row is formed. In the first row, the complementary rabbets 10, 11 are fitted into each other and the stone slabs 4 are separated by vertical joints having a width equal to that of the shoulder 6 of the core 5.

A second row of facing plates is then put in position at 4'*a*, 4'*b* . . . 4'*n*, the plates forming this second row being engaged by their lower female fitting formation 8 onto the male fitting formation 9 of the upper portion of the core 5 of the plates 4, 4*a*, 4*b* . . . 4*n* of the first row. The second row is only maintained by retention studs devices 13. The following rows are henceforth mounted in the very same manner.

As it will be apparent from the foregoing disclosure, during the initial assembly, the vertical efforts of the various facind plates are transmitted by their respective core to the cores of the facing plates of the rows immediately underneath, the assembly of plates being supported by the brackets 3.

When a sufficient number of plates has thus been assembled, a connection mortar, for providing the grout jointing of the stone slabs 4, is introduced in the space between the stone slabs 4. Because of the jointing mortar, the loads due to the stone slabs 4 as such are transmitted between the stone slabs 4 without this load being then supported by the insulating material cores 5.

The retention stud devices 13 do not support any load, their function consisting in preventing the stone slabs 4 from tilting away from wall 1, if subjected to impacts or to action of a wind.

When the wall 1 is irregular or when its surface evenness is not good, which is the most frequent case, it is advantageous to introduce a flexible insulation panel 23 (FIG. 1) between the rear face of the plate core 5 and the wall. The flexible insulation panel 23 can be for example made of rock wool, granulates of expanded material, or other similar products. The flexible insulation panel 23 can be disposed only in certain places, for example at the periphery, around the openings and in the vicinity of the angles for avoiding air circulation.

Although the various facing plates can support themselves onto each other without complementary means, it is advantageous to use brackets similar to the brackets 3, for example every 3 to 6 meters, that is approximately for every floor or every second floor of a building. Thus are formed decompression joints.

For low buildings, for example detached houses, the brackets 3 can be omitted, the first row of facing plates bearing then simply on a sole made for example of cement.

In FIGS. 5 through 9, and instead of using retention stud devices 13 for supporting the facing construction the support device 13*a* is made of a synthetic material such as a polyamide charged with mineral fibers. The support device 13*a* comprises a sole 14*a* from which protrudes a gallow bracket 25.

The sole 14*a* is formed with an opening 26 of a height and a width which is larger than diameter of an anchoring bolt 27 extending through a bearing plate 28.

The foregoing disclosure shows that the sole 14*a* can be adjusted in height, in width and angularly prior to be secured adainst motion by tightning the anchoring bolt 27 and by consequently tightning the bearing plate 28 onto the sole 14*a*.

The gallow bracket 25 which protrudes from the lower portion of the sole 14*a* is advantageously reinforced by ribs 29 extending over a certain distance, for example over the third of the first gallow bracket 25.

At its free end, the gallow bracket 25 is formed with rows of holes 30 provided for receiving retention studs 31 (FIG. 9) with a tight fit.

Figures 5, 6, 7, 8, 9:
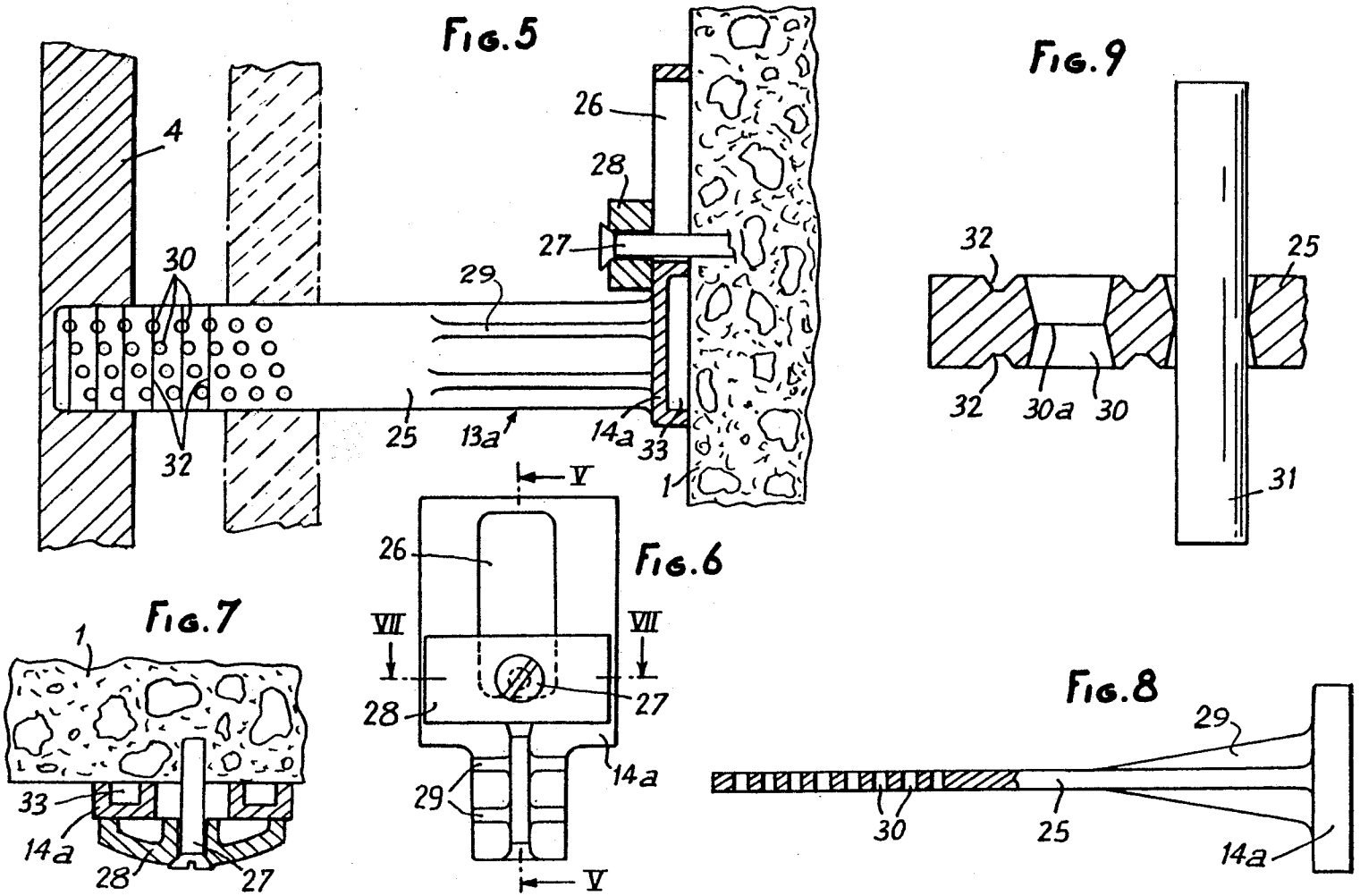
FIG. 5 is a partially sectional elevation view of a retention device along line V—V of FIG. 6.
FIG. 6 is an elevation view turned by 90° C. and corresponding to FIG. 5.
FIG. 7 is a sectional view along line VII—VIII of FIG. 6.
FIG. 8 is a partially broken away top view of a part of FIG. 5.
FIG. 9 is an enlarged sectional view of a detail of embodiment.

As shown in FIG. 9, the holes 30 are biconical and have in their medium portion a contracted portion 30*a*.

Moreover, and as better shown in FIG. 9, grooves 32 are provided in the side of the gallow bracket 25, either between the rows of holes 30 or, as shown in FIG. 5, in a manner such that a groove 32 will intercept one of the holes 30 and extends between the other holes.

When the holes 30 are disposed obliquely as shown in FIG. 5, it is possible also that the grooves 32 which are advantageously formed on both sides of the gallow brackets 25 are arranged obliquely.

It is further advantageous that the sole 14*a* of the support device 13*a* has a back portion formed with recesses 33 in order to accommodate possible irregularities of the wall 1.

In order to put the wall facing construction in position, one can proceed as follows:

First of all, a first bracket 3 is fixed; a first composite facing element having holes in the stone slabs 4 for corresponding to studs of each bracket 3 are put in position; a second bracket 3 is put in position; then on either side of the facing element supported by the two brackets 3 are placed two support devices 13*a* with the retention studs 31 being forcibly engaged inside the holes 30 of the gallow bracket 25.

The first facing place is thus maintained at four points while bearing on two brackets 3. It can be advantageous to introduce a resin or any other bonding material in the holes in which are engaged the retention studs 31. The fact that the retention studs 31 are forcibly engaged makes their sliding relatively difficult and this prevents that they could spontaneously go out before being introduced in a hole 12 of a stone slab 4, but the biconical shape of the holes 12 enables on the other hand to accommodate alignment defects of the gallow brackets 25.

Then, and in the same manner, other plates 4*a*, 4*b* . . . 4*n* are put in position until the first row is complete.

A second row of facing plate is then put in position at 4'*a*, 4'*b* . . . 4'*n*. The second row is only maintained by the support devices 13*a* with retention studs 31. The following rows are then put in position in the same manner.

Since, the gallow bracket 25 can be cut along the grooves 32, the facing plates or stone slabs 4 can be spaced more or less from the wall 1, as shown in full lines and in phantom in FIG. 5.

Figure 10:
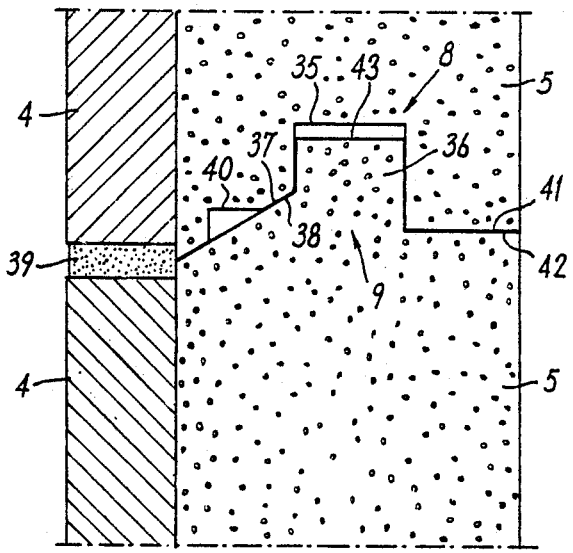
FIG. 10 is a partially schematic sectional view showing an assembly of two consecutive plates.

In FIG. 10, the female fitting formation 8 includes a groove 35 which is deeper than a protrusion 36 of the male fitting formation 9. On the other hand, the female as well as the male fitting formations 8, 9 form slanting planes 37, respectively 38, with the a same inclination, which come to the joint designated at 39 and which is made with a mortar.

The slanting plane 37 of the female fitting formation 8 comprises a rupture defined by a recess 40. In order to define accurately the thickness of the joint 39, the female and male fitting formations 8, 9 define support surfaces 41 and 42 the disposition of which being such that a space 43 is maintained free between the protrusion 36 and the bottom of the slot 35 when the two support surfaces 41, 42 bear against each other and when the slanting planes 37, 38 bear also against each other.

Figure 2:
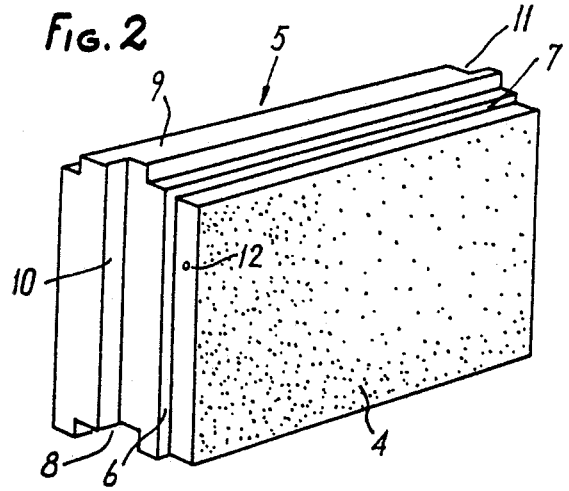
FIGS. 2 and 3 are perspective views each showing a facing composite element with apparent stones.

The way the side rabbets 10, 11 of FIGS. 2 and 3 are made is similar in order to allow the same type of fitting formations.

Figure 11:
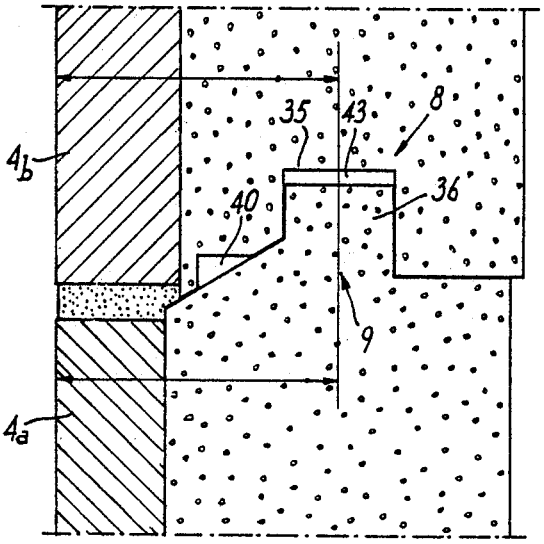
FIG. 11 is a sectional view similar to FIG. 10 showing one of the results provided by the assembly of FIG. 10.

For providing the hereabove fitting formations and the rabbets, the core 5 is set into shape starting from the outer face of the stone slabs 4, which allows accommodating possible thickness variations of the stone slabs 4 as shown in FIG. 11 for the plates 4*a* and 4*b*.

An advantageous embodiment consists in glueing each stone slab 4 on a core 5, then to make the fitting formations and rabbets by a milling operation, by taking as reference the surface of the outer face of each plate. One can also mold the core 5 directly on the stone slabs 4.

The hereabove embodiment allows obtaining that the stone slabs 4 are situated in the same plane. On the other hand, the rupture formed by the recess 40 provided in the slanting plane 37 avoids any penetration of water upwardly by capillarity. Possibly, a similar rupture can be provided in the bearing surfaces 41, 42.

The scope of the invention is not limited to the specific embodiments shown and described in detail since various modifications thereof can be carried out thereto without departing from its scope as shown in the appended claims.

What is claimed is:

1. A composite wall facing construction with apparent stones made of facing plates each comprising a stone slab fixed to a core made of an insulating material, the stone slab being formed with at least two holes in its side for receiving retention studs connected to a wall, the facing plates being stacked onto each other, guided and supported in position by the cores with the stone slabs having their edges spaced from edges of adjacent stone slabs, and a mortar joint being packed between the spaced edges of the stone slabs so that compression forces due to weight of the stone slabs is transmitted by said mortar joint, the core comprising corresponding female and male fitting formations as well as complementary side rabbets.

2. A facing construction according to claim 1, wherein the core to which is fixed the stone slab of each facing plate protrudes on two sides of the stone slab for defining a thickness of a joint which has to separate the stone slab prior to setting in position of the mortar joint.

3. A facing construction according to claim 1, comprising slots provided between the stone slab and the core.

4. A facing construction according to claim 1, wherein the holes are provided in at least one vertical side edge adjacent the upper side of said stone slabs.

5. A facing construction according to claim 1, further comprising brackets on which bear some rows of facing plates, said brackets comprising studs introduced into said holes of the stone slabs.

6. A facing construction according to claim 1, wherein the holes are filled with a bonding material prior to introduction of the retention studs.

7. A facing construction according to claim 1, wherein the retention studs are carried by an adjustable device which is fixed to a wall in front of which is mounted the facing construction.

8. A facing construction according to claim 7, wherein the adjustable device includes a rough stem, said rough stem having a head carrying the retention studs, said stem being engaged inside a slit bolt provided with a tightening nut and supported by a sole formed with an oblong hole for passage of a fixation pin.

9. A facing construction according to claim 1, comprising a flexible insulation interposed between the facing plates and a wall.

10. A facing construction according to claim 1, wherein the retention studs are placed in one of holes formed in a gallow bracket rigidly connected to a sole integrally formed by molding with said gallow bracket.

11. A facing construction according to claim 10, wherein the sole is formed with an opening of greater width that an anchoring bolt extending through a bearing plate which bears on top of said sole.

12. A facing construction according to claim 10, wherein the sole has a rear face formed with recesses.

13. A facing construction according to claim 10, wherein the gallow bracket is formed with a series of holes of biconical shape for defining a contracted portion in which a retention stud is forcibly engaged.

14. A facing construction according to claim 13, wherein the gallow bracket is formed with grooves on one at least of its sides, said grooves extending between at least some of the holes disposed according to a plurality of rows.

15. A facing construction according to claim 13, wherein said holes are offset.

16. A facing construction according to claim 12, wherein the sole and gallow bracket assembly is molded in a resin.

17. A facing construction according to claim 1, wherein the female and male fitting formations as well as the complementary side rabbets are respectively formed, with a slot, and with a protrusion, support surfaces and slanting planes being formed on said fitting formation and side rabbets, with one of said support surfaces and slanting plane having a ruptured portion defined by a recess.

18. A facing construction according to claim 17, wherein a space is provided between the protrusion and a bottom of the slot when the support surfaces and slanting planes bear together.

19. A facing construction according to claim 1, wherein the male and female fitting formations are made by taking as reference an outer face of the stone slab.

20. A facing construction according to claim 18, wherein the slanting planes lead to a joint separating two slabs.

21. A facing construction according to claim 1, comprising a granulated insulation interposed between the facing plates and a wall.

22. A facing construction according to claim 16, wherein the resin is a polyamide reinforced with mineral fibers.

* * * * *